US005296327A

United States Patent [19]

Pennings et al.

[11] Patent Number: 5,296,327

[45] Date of Patent: Mar. 22, 1994

[54] TONER POWDER FOR THE DEVELOPMENT OF LATENT ELECTROSTATIC OR MAGNETIC IMAGES AND A PROCESS FOR FORMING FIXED IMAGES ON AN IMAGE RECEIVING MATERIAL

[75] Inventors: Marcel L. M. Pennings, KH Horst; Rudolf A. M. Venderbosch, CA Arnhem; Wilhelmus H. G. Albrink, LG Horst; Gerardus J. Crommentuyn, PV Lottum, all of Netherlands

[73] Assignee: Oce-Nederland B.V., Venlo, Netherlands

[21] Appl. No.: 850,886

[22] Filed: Mar. 13, 1992

[30] Foreign Application Priority Data

Mar. 15, 1991 [NL] Netherlands ..... 9100457

[51] Int. Cl.[5] ..... G03G 5/00

[52] U.S. Cl. ..... 430/109; 430/904

[58] Field of Search ..... 430/109, 110, 904

[56] References Cited

FOREIGN PATENT DOCUMENTS 1373220 11/1974 United Kingdom .
2014325 8/1979 United Kingdom .

OTHER PUBLICATIONS

World Patents Index Latest Week 0486, Derwent Publications Ltd., London, GB; AN 86-025052 and JP-A-6-0-247 251 (Konishiroku Photo K.K.) Dec. 6, 1985 abstract only.

Patent Abstracts of Japan, vol. 14, No. 405 (P-1100)(4348) Aug. 31, 1990 and JP-A-2 156 253 (Ricoh Co Ltd) Jun. 15, 1990.

Patent Abstracts of Japan, vol. 15, No. 158 (P-1193)(4686) Apr. 19, 1991 and JP-A-3 028 858 (Ricoh K. K.) Feb. 7, 1991.

Patent Abstract of Japan, vol. 11, No. 91 (P-558)(2538) Mar. 23, 1987 and JP-A-61 241 765 (Hitachi Ltd) Oct. 28, 1986.

*Primary Examiner*—Marion E. McCamish
*Assistant Examiner*—Stephen Crossan
*Attorney, Agent, or Firm*—Birch, Stewart, Kolasch & Birch

[57] ABSTRACT

A toner powder for the development of latent electrostatic or magnetic images, the toner powder containing a polyester resin based on an etherified diphenol and a dicarboxylic acid mixed with a reaction product of an epoxy resin and a phenol compound or a carboxylic acid, and the process for forming fixed images on an image receiving material utilizing the above toner powder, the surface of an intermediate medium consisting of material having a lower affinity for the softened toner powder than does the image receiving material and the toner powder being softened by heating before and/or during transit through a pressure zone.

12 Claims, No Drawings

TONER POWDER FOR THE DEVELOPMENT OF LATENT ELECTROSTATIC OR MAGNETIC IMAGES AND A PROCESS FOR FORMING FIXED IMAGES ON AN IMAGE RECEIVING MATERIAL

BACKGROUND OF THE INVENTION

2. Field of the Invention

The present invention relates to a developer composition and more specifically to a toner powder for the development of latent electrostatic or magnetic images, and to a process for fixing toner developed images on an image receiving material.

2. Discussion of the Related Art

There is disclosed in British Patent 1,373,220 a toner powder comprising a polyester resin based on an etherified diphenol and a dicarboxylic acid, and, if required with acids having more than two carboxyl groups or alcohols having three or more hydroxyl groups. It has been found in practice that in the preparation of such thermoplastic resins it is difficult to control the spread in thermal properties of the resulting product. Another disadvantage of the use of such thermoplastic resins in the preparation of toners, is that despite the fact that the fixing temperature of such a toner powder prepared with these resins can be reduced, for example, by controlling the molecular weight distribution thereof, the storage stability, is adversely affected by such adaption.

Furthermore, in order to function properly, toner powders must satisfy a large number of other requirements. The conventional method of preparing a toner powder is to mix the constituents in the melt, cool the melt, and then grind and screen it to the correct particle size. The toner must, accordingly, be well adapted to grinding and satisfy certain requirements with respect to toughness and brittleness. During storage the toner powder must also be stable over a wide temperature range and at extreme relative humidities in order to avoid caking. In addition, the toner powder must not agglomerate under conditions prevailing in a developing device, such as mixing, high temperature, and so forth. It has been found in practice that a glass transition temperature higher than 40° C. is favorable to the avoidance of agglomeration. Furthermore, deposition of toner resin on a photoconductor affects the photoelectric properties of the photoconductor. Accordingly, the toner powder should not leave any non-removable residues on the photoconductor.

The toner image should also be capable of being satisfactorily fixed on a receiving material. The toner image should be fixed so that it is scarcely removed, if at all, under mechanical loads such as by folding and rubbing. The fixing temperature in these conditions should be as low as possible so as to satisfy minimum energy consumption.

The working range of a toner powder should, preferably, be so wide that any temperature inequalities occurring in the fixing station are taken into consideration. The working range of a toner powder is defined as the temperature range between the lower fusing limit, the lowest possible fixing temperature at which the toner image is still adequately fixed, and the upper fusing limit, the maximum fixing temperature at which, using for example the hot-roll fixing method, no toner is deposited on the fixing roller (the "hot roll").

It must also be possible to provide both sides of a receiving material with a toner image. With double sided or "duplex" copying, it is a conventional practice to provide first one side of the receiving material with a toner image, to fix this toner image on the receiving material, to turn the receiving material over, and then provide the other side with a toner image and fix that toner image. This may result in the deposition of toner powder from the toner image on the pressure rollers, which would necessitate regular cleaning of such rollers, and may also cause soiling of subsequent copies. During the last fixing step the first toner image fixed must not be subjected to deformation or become detached from the paper. This means that the softening range and the adhesive and cohesive properties of the toner powder must satisfy certain requirements. Moreover, after the heat treatment, the fixed toner image must rapidly become permanent and lose its tackiness in order to avoid any damage to the toner image on transport through the copying machine.

SUMMARY OF THE INVENTION

Therefore, it is an object of the present invention to provide a developer composition which will overcome the above noted disadvantages.

It is a further object of the present invention to provide a novel toner powder for developing a latent electrostatic and magnetic image.

Yet, a further object of the present invention is to provide a toner composition which enhances the forming of fixed images on a receiving material.

Still a further object of the present invention is to provide a novel developer which satisfies the demanding requirements of a superior toner powder.

Another object of the present invention is to provide an improved process of forming fixed toner images on an imaging material.

The foregoing objects and other are accomplished in accordance with the present invention, generally speaking, by providing a toner powder comprising a polyester resin based on an etherified diphenol and a dicarboxylic acid. The polyester resin is mixed with a reaction product of an epoxy resin and a phenol compound or a carboxylic acid. A toner powder of this composition is simple to make, can readily be fixed on a receiving material, and can be made suitable for use at different fixing temperatures and speeds by selecting the proper resins and ratios. With such a toner powder, the lower fusing temperature limit at which the toner image can be fixed on a receiving material is much lower in comparison with the lower fusing temperature limit of toner powder with the same polyester resin without the addition of the epoxy resin reaction product.

Suitable epoxy resins that may be used in accordance with the present invention include, for example, the Epikote resins (commercially available from Shell), such as Epikote 828, 838 and 1001. In addition, many other epoxy resins can be used which contain one or more epoxy groups per molecule. These epoxy resins are saturated or unsaturated, aliphatic, cycloaliphatic, aromatic or heterocyclic, and may be substituted with substituents such as halogen atoms, hydroxyl groups, alkyl, aryl or alkaryl groups, alkoxy groups and the like.

The phenol compounds suitable for reacting with the epoxy resins in the preparation of the toner powder according to the invention are those compounds which have at least one hydroxyl group bonded to an aromatic nucleus. An etherification process takes place on reaction between the epoxy resin and the phenol compound. A reaction of this kind is also known as blocking. Any suitable phenol compound may be used in the course of the present invention. Examples of suitable phenols are phenol, 2,2-bis(4-hydroxyphenyl)propane, o-tert.butylphenol, p-sec. butylphenol, octylphenol, p-cyclohexylphenol, α-naphthol and β-naphthol.

Other blocking agents such as monofunctional carboxylic acids may be used. Examples of suitable carboxylic acids are phenylacetic acid, diphenylacetic acid and p-tert.butylbenzoic acid.

The selection of a specific polyester resin depends on the required use of the toner powder. Linear polyester resins based on the diols and dicarboxylic acids as described in Great Britain 1,373,220 are suitable for use in the toner powder according to the present invention. Although not preferred, branched polyester resins as described in Great Britain 1,373,220 are also suitable within certain limits. The suitability in such cases depends inter alia on the miscibility of the polyester resin with the reaction product of the epoxy resin and the phenol compound or the carboxylic acid.

Any suitable diol may be used in the course of the present invention. Typical diols are, inter alia, etherified bisphenols, such as polyoxyethylene(2)-2,2-bis(4-hydroxphenyl)-propane, polyoxypropylene(3)-2,2-bis(4-hydroxyphenyl)-propane, polyoxypropylene(3)-bis(4-hydroxphenyl)-sulphone, polyoxyethylene(2)-bis(4-hydroxyphenyl)-sulphone, polyoxypropylene(2)-bis(4-hydroxphenyl)-thioether and polyoxypropylene (2)-2,2-bis(4hydroxyphenyl)-propane or mixtures of these diols, in which a plurality of oxyalkylene groups per molecule of bisphenol may be present. This number is preferably between 2 and 3 on an average. It is also possible to use mixtures of etherified bisphenols and (etherified) aliphatic diols, triols, etc.

Any suitable dicarboxylic acid may be used in the course of the present invention. Examples of typical such carboxylic acids are phthalic acid, terephthalic acid, isophthalic acid, cyclohexane dicarboxylic acid, fumaric acid, maleic acid, malonic acid, succinic acid, glutaric acid, adipic acid and anhydrides of these acids. Furthermore, esters, e.g. methyl esters of these carboxylic acids, are also suitable.

It should be mentioned here that toner powders based on mixtures of polyesters and epoxy resins are known per se. U.S. Pat. No. 4,693,952 describes a toner powder which comprises a polyester resin and an epoxy resin such as, for example, Epikote 1004. However, due to the presence of reactive epoxy groups, a toner resin of this kind is mutagenic in the Ames test and also unstable in time. Also, branching of the polyester is necessary in order to avoid deposition of toner resin on hot parts of the fixing device and owing to the softening temperatures of the toner powders high fixing temperatures are necessary.

Preferably, a toner powder is used characterized in that the polyester resin has a numberaveraged molecular weight of at least 2500, the epoxy resin has a number-averaged molecular weight of less than 1200 and the epoxy groups of the epoxy resin are blocked at least 60% by a phenol compound. Both resins, the polyester resin and epoxy resin are well miscible and the resulting toner powder has favorable thermal properties.

The reaction product of the epoxy resin and the phenol compound preferably contains less than 50 mmol free epoxy groups per kg of reaction product. By allowing the epoxy groups remaining after etherification or blocking with the monofunctional phenol compound to react, the reaction product has practically no remaining reactive epoxy groups, so that the stability of the toner powder produced therewith is improved and the toner powder is not mutagenic in the Ames test. For use as a colored toner powder, for example, it is advantageous if the epoxy groups of the epoxy resin are blocked at least 80% by the monofunctional phenol compound. With such a degree of blocking, in fact, relatively clear resins are obtained.

Particularly preferred is a toner powder which is characterized in that the polyester resin is mixed with a reaction product of an epoxy resin containing mainly the diglycidyl ether of 2,2-bis(4-hydroxyphenyl)propane and a monofunctional phenol compound. One example of such an epoxy resin is Epikote 828 (commercially available from Shell). The reaction product of such an epoxy resin can be prepared with very constant properties so that any variation in thermal properties of the toner powder made therewith is reduced.

In toner powders according to the present invention, the ratio of polyester resin to reaction product of the epoxy resin and phenol compound may be varied between 80:20 and 20:80. Toner powders of this kind have a sufficiently wide working range. The temperature difference between the glass transition temperature and the lower fusing limit of the toner powders according to the present invention is also significantly reduced in comparison with the temperature difference between the glass transition temperature and the lower fusing limit of toner powder prepared with polyester resin without the addition of the epoxy resin reaction product. Consequently, while powder stability is retained, the fixing temperature of such toner powders is lower so that the energy consumption for fixing is reduced. Preferably, the toner powder ratio of the polyester resin to reaction product of the epoxy resin and phenol compound is between 60:40 and 30:70. Toner powders of this kind are in practice less sensitive to variations in visco-elastic properties of the higher molecular weiqht polyester resin. As a result, the requirements to be satisfied in respect of the polyester resin product constancy are reduced.

In practice it has been found favorable if the glass-transition temperature of the reaction product of the epoxy resin and the phenol compound is above 35° C. Toner powders comprising such a reaction product have exhibited hardly any agglomeration problems, if any, on storage. Preferably, the glass-transition temperature of the reaction product of the epoxy resin and the phenol compound is above 45° C. As a result of the high glass transition temperature it is possible to make toner powders in which the mixing ratios can be selected freely within wide limits for uses at different fixing temperatures and speeds.

Preferably, the polyester resin is mainly a reaction product of one or more alkoxylated bisphenol compounds and one or more aromatic and/or fully saturated dicarboxylic acids or their corresponding esters. As contrasted with toner powders in which polyesters with reactive groups such as unsaturated bonds are present, toner powders prepared with such a resin have improved stability so that hardening on hot components is virtually prevented. Particularly preferred is a toner powder whose polyester resin is mainly a reaction product of ethoxylated 2,2-bis(4-hydroxyphenyl)propane and phthalic acid or a phthalic acid ester. A toner powder of this kind has a sufficiently high glass transition temperature and also a surprisingly low lower fusing limit, so that the energy required to fix a toner image prepared with this toner powder is relatively low.

The invention also relates to a process for forming fixed images on an image receiving material, in which an image is applied to a medium by means of toner powder comprising the polyester thermoplastic resin of the present invention, the surface of the medium consisting of a material having a lower affinity for the softened toner powder than does the image receiving material, whereas the toner powder is softened by heating before and/or during transit through a pressure zone. A process of this kind is described, for example, in British Patent 1,245,425 and U.S. Pat. Nos. 3,554,836 and 3,893,761. In these processes, a powder image formed, for example, on a photoconductive or maqnetizable image recording material is transferred, by the application of pressure, to a medium whose surface consists of a material having a low affinity for the softened powder, e.g. silicone rubber. The powder image is then again transferred, by pressure application, to an image receiving material, the powder being softened by heating before and/or during transit through the pressure zone, acquiring properties such that as a result of the pressure applied the toner powder forms a cohesive layer which penetrates at least partially into the image receiving material. After cooling the image is durably bonded to the receiving material.

Heretofore, for use in this process the toner powders proposed included those which contain polyesters, polystyrene or epoxy resin as the thermoplastic resin. Using such toner powders it is possible to embody working systems, but it has been found that these systems have deficiencies. One of the disadvantages is that the working range continually decreases and after some tens of thousands of imaging cycles the medium reaches a situation in which there is no practical working range. Thermal degradation of the medium appears to play a part in this. Another disadvantage in practice is that the material deposited on the medium is partly returned to the image recording material by the medium so that it is rendered unsuitable for further use.

In order to overcome these disadvantages the present invention implements such a process as indicated above, which is characterized in that the image is developed by means of a toner powder containing a polyester resin based on an etherified diphenol and a dicarboxylic acid and the polyester resin is mixed with a reaction product of an epoxy resin and a phenol compound or a carboxylic acid. It has been found in practice that when such a toner powder is used in the process according to the present invention the working range remains reasonably constant even after many tens of thousands of imaging cycles.

The exact position and size of the working range are determined, not only by the properties of the toner powder itself, but also by the geometry of the device in which the process according to the invention is performed, the speed at which the device operates, the composition and hardness of the medium to which the toner powder is applied imagewise, the way in which the toner powder is softened and the pressure with which the softened toner powder is transferred to the image receiving material. The contact time, in particular, between the medium bearing the powder image and the image receiving material is a factor which considerably governs the working range.

The working range can readily be determined for a specific device by measuring the temperature range within which complete transfer and good adhesion of the powder image are obtained. A reasonable indication of the position and size of the working range of a specific toner powder can be obtained by measuring the visco-elastic properties of the toner powder. Generally speaking, the working range of the toner powder corresponds to the temperature range within which the loss compliance (J″) of the toner powder, measured at a frequency equal to 0.5 times the reciprocal of the contact time in the device for performing the process according to the invention, is between $10^{-4}$ and $10^{-6}m^2/N$. The visco-elastic properties of the toner powder are measured in a rheometer, the moduli G′ and G″ determined as a function of the frequency at a number of different temperatures. The curves found are then reduced to one curve at one temperature, the reference temperature. From this reduced curve the loss compliance (J″) is calculated as a function of the frequency. The displacement factors of the lower fusing limit and upper fusing limit temperatures ($J''=10^{-6}$ and $J''=10^{-4}m^2/N$, respectively) of the working range can then be read off from the loss compliance-frequency-curve. The lower and upper fusing limit temperatures of the working range can then be calculated by means of the WLF equation (Williams-Landell-Ferry equation as described in "Viscoelastic properties of polymers" by J. D. Ferry, John Wiley, 1971) compiled from the displacement factors found at different temperatures.

The weight-averaged molecular weight of the polyester and epoxy resins is determined by GPC (Gel Permeation Chromatography) measurement with UV and refractive index detection.

In addition to the thermoplastic resin, the toner powder also contains coloring material, which may consist of carbon black, inorganic or organic pigment or dye. The toner powder may also contain other additives, the nature of which depends on the manner in which the toner powder is applied. Thus, toner powder for the development of latent magnetic images, which is fed by a magnetic conveying means to an electrostatic image to be developed, or toner powder for Magnetic Ink Character Recognition (MICR) applications, will also contain a magnetizable or magnetic material, usually in an amount of from 30 to 70% by weight. Toner powders which are used for the development of electrostatic images may also be rendered electrically conductive in a manner known per se, by finely distributing therein electrically conductive material, e.g. carbon, tin oxide, copper iodide or any other suitable conductive material, in appropriate quantity, in the powder particles or deposited on the surface of the powder particles. If, for the development of electrostatic images, the toner powder is used in a so-called two-component developer, in which the toner powder is mixed with carrier particles, then the toner powder particles may also contain a charge control agent that causes the toner powder particles, upon tribo-electric charging, to assume a charge having a polarity opposite to that of the electrostatic image to be developed. Known materials suitable for the purpose of being used as a carrier particle include, e.g. iron, ferrite or glass. The carrier particles may be provided with one or more layers of toner particles completely or partially covering the carrier particles.

It has been found in practice that the toner powders according to the present invention are satisfactorily usable in a two-component developer, inter alia because of the very good impact strength and resistance to wear (abrasion resistance) of the resulting toner powder particles. In particular it has been found that the use of the toner powder according to the present invention significantly reduces the progressive deterioration of the triboelectric charging properties.

Known materials may be used for the magnetizable or magnetic material, electrically conductive material and charge control agent. Also possible is the addition of material, for example, to increase the powder stability or improve the flow behavior of the toner powder. Silica is a conventional additive for this purpose. Other thermoplastic resins known for use in toner powders can also be used as an additive in the toner powder according to the present invention. Examples of such resins are, inter alia, vinyl resins, polyurethane resins, cellulose resins and polyamide resins.

In electrophotography and electrography an electrostatic latent image is formed in a known manner on an image support. Thus, in electrophotography a photoconductor surface is charged and then exposed imagewise and in electrography the charge is applied imagewise to an image support. The latent electrostatic image is then developed to form a visible image using toner powder. This is done, inter alia, by means of known development methods such as magnetic brush development, cascade development and powder cloud development. The toner image can then be fixed directly onto the image support or, as in the case of indirect electrophotography and magnetography, transferred to a receiving material and fixed thereto in a known manner, e.g. under the influence of heat (the radiation fixing method), under the influence of heat and pressure (the hot-roll fixing method), under the influence of microwave radiation or by means of flash fixing.

PREFERRED EMBODIMENTS

The invention will be further explained in detail with reference to the following examples representing various preferred embodiments. Parts and percentages are by weight unless otherwise indicated.

Example 1

For the preparation of the reaction product of an epoxy resin and a phenol, 100 parts of Epikote 828 and 72.5 parts of p-phenylphenol were mixed with one another at a temperature of 105° C. in a reaction vessel, after which 0.1 part of an alkali halide catalyst was added. A process of this kind is described inter alia in U.S. Pat. No. 3,978,027. The mixture was then heated for 5 hours at 150° C., after which the reaction mixture was heated for another 2 hours at 200° C. to react away the remaining epoxy groups. In this way a relatively clear resin was obtained with a glass transition temperature (Tg) of 48.5° C. and a free epoxy group content of less than 40 mmol per kg of reaction product.

Example 2

30 parts of a reaction product of Epikote 828 and p-phenylphenol from Example 1 and 20 parts of polyester resin based on polyoxyethylene (2)-2,2-bis(4-hydroxyphenyl)-propane and dimethylphthalate, with a Tg of 61° C. (Mn 8000) and 50 parts of magnetic pigment (Bayferrox 318 M of Bayer A. G.) were kneaded intensively at a temperature of 105° C. for 2 hours. The mixture was then processed in known manner by grinding and screening to give a toner powder having particles between 10 and 30 μm. The toner powder was then rendered conductive with carbon black using the process of NL-B-168347 (resistance $2.3\times10^5$ ohm.m). The resulting toner powder was used in an electrophotographic copying machine as described in European Patent Application 045 102. The toner image obtained in known manner was applied to a medium consisting of a steel roller having a crosssection of 100 mm, to which a 1.7 mm thick pigmented RTV silicone rubber layer had been applied, said layer also being provided with an RTV top layer of 50 μm in accordance with NL-A-8801669. This medium provided with the toner image was heated and brought into contact at a linear pressure of 1500 N/m with a receiving material heated to 92° C. Océ plain paper was used as receiving material. The lower fusing limit at which the toner powder was sufficiently fixed to the paper was found to be 86° C. and the working range was about 19° C. The Tg of the resin mixture of the toner powder was 51° C. For comparison, a toner powder prepared in the identical manner and having, as thermoplastic resin, a polyester resin based on maleic acid anhydride and polyoxypropylene(2)-2,2-bis(4-hydroxyphenyl)-propane with a Tg of 53.5° C., was used in the same apparatus. With this toner powder the lower fusing limit was 104° C. while the working range was 17° C.

Example 3

Three toner powders were prepared with a thermoplastic resin containing 60% by weight of the reaction product from Example 1 and 40% by weight of polyester resin based on polyoxyethylene(2)-2,2-bis(4-hydroxyphenyl)-propane and dimethylphthalate, with different number-averaged molecular weights (Mn). The results of the lower fusing limits determined by measurements of the visco-elastic properties, and working ranges, of the toner powders are given in the following table.

| Toner Powder | Mn | Lower Fusing Limit (°C.) | Working Range Width (°C.) |
|---|---|---|---|
| 3a | 8000 | 91 | 19 |
| 3b | 6000 | 87 | 16 |
| 3c | 3000 | 81 | 13 |

With a lower Mn, the width of the working range becomes too small for practical use, because of temperature inequalities in fixing devices, spreads in temperature adjustments of different fixing devices, and the like.

Example 4

Three toner powders were prepared in accordance with Example 2 with a thermoplastic resin containing 60% by weight of the reaction product of Epikote 828 (Shell) and p-phenylphenol and 40% by weight of polyester resin from Example 2, the epoxy resin being etherified or blocked with 70, 80 and 90% p-phenylphenol as in Example 1. The results of the lower fusing limits determined by measurements of the visco-elastic properties, and working ranges, of the toner powders are given in the following table.

| Toner Powder | Degree of Blocking | Tg (°C.) | Lower Fusing Limit (°C.) | Working Range Width (°C.) | Color |
|---|---|---|---|---|---|
| 4a | 70 | 54 | 87.5 | 19 | Brown |
| 4b | 80 | 51.5 | 84.5 | 18.5 | Relatively Clear |
| 4c | 90 | 50 | 82 | 18 | Relatively Clear |

Toner powders in which the degree of blocking is 80% or higher are relatively clear and hence favorable, for example, for color toner applications.

Example 5

Toner powders were prepared in accordance with Example 2 with a thermoplastic resin mixture containing in different proportions a polyester based on polyester resin based on maleic acid anhydride and polyoxypropylene(2)-2,2-bis(4-hydroxyphenyl)-propane and the reaction product of 100 parts of Epikote 828 (Shell) and 90 parts of p-cumylphenol prepared in accordance with Example 1. The reaction product had a Tg of 35.5° C. The results of the lower fusing limits determined by measurements of the visco-elastic properties, and working ranges, of the toner powders are given in the following table.

| Toner Powder | Reaction Product % by Weight | Tg Mixture (°C.) | Lower Fusing Limit (°C.) | Working Range Width (°C.) |
|---|---|---|---|---|
| 5a | 0 | 54.5 | 104 | 19.5 |
| 5b | 10 | 51 | 99.5 | 19.5 |
| 5c | 20 | 49 | 93.5 | 19.5 |
| 5d | 30 | 46 | 87.5 | 18 |
| 5e | 40 | 44 | 83.5 | 17 |
| 5f | 50 | 41 | 78 | 16 |

It will be clear from this table that the lower fusing limit falls sharply with increasing reaction product content while the working range remains sufficiently wide.

Example 6

Toner powders were prepared similarly to Example 5 with a thermoplastic resin mixture containing in different proportions a polyester resin based on polyoxyethylene(2)-2,2-bis(4-hydroxyphenyl)-propane and dimethylphthalate, with a Tg of 57° C. and the reaction product of Example 1. The reaction product had a Tg of 49° C. The results of the lower fusing limits determined by measurements of the visco-elastic properties, and working ranges, of the toner powders are given in the following table.

| Toner Powder | Reaction Product % By Weight | Tg Mixture (°C.) | Lower Fusing Limit (°C.) | Working Range Width (°C.) |
|---|---|---|---|---|
| 6a | 0 | 57 | 117.5 | 25 |
| 6b | 20 | 54.5 | 105.5 | 23.5 |
| 6c | 40 | 54 | 94.5 | 20.5 |
| 6d | 60 | 51 | 87.5 | 16 |
| 6e | 80 | 49 | 81.5 | 12.5 |

It will be seen from these results that the ratio of reaction product to polyester can be varied within wide limits with a reaction product Tg of 49° C. while retaining a sufficiently wide working range. The toner powders having a reaction product % by weight of 40–60% are particularly favorable because of the combination of the relatively wide working range and the low lower fusing limit.

Example 7

Four toner powders were prepared with a thermoplastic resin containing 40% by weight of the reaction product from Example 1 and 60% by weight of polyester resin based on polyoxyethylene(2)-2,2-bis(4-hydroxyphenyl)-propane and respectively dimethylphthalate (A), dimethylterephthalate (B), dimethylisophthalate (C) and a 30:70 mixture of adipic acid and terephthalic acid (D). The results of the lower fusing limits determined by measurements of the visco-elastic properties, and working ranges, of the toner powders are given in the following table.

| Toner Powder | Polyester | Tg Polyester (°C.) | Tg Mixture (°C.) | Lower Fusing Limit (°C.) | Working Range Width (°C.) |
|---|---|---|---|---|---|
| 7a | A | 61 | 51.5 | 97.5 | 25 |
| 7b | B | 72 | 58.5 | 104.5 | 23 |
| 7c | C | 65 | 56.5 | 106.5 | 22 |
| 7d | D | 60 | 51 | 91 | 18 |

Example 8

Toner powders were prepared in accordance with Example 2 with a thermoplastic resin containing 60% by weight of the reaction product of Epikote 828 (Shell) and a phenol compound or carboxylic acid and 40% by weight of polyester resin from Example 2, Epikote 828 (Shell) being etherified or blocked in accordance with Example 1 with, respectively, p-phenylphenol (E), o-phenylphenol (F), p-cumylphenol (G), 2,4 ditert.Butylphenol (H), p-cyclohexylphenol (I), α-naphthol (J), β-naphthol (K) or diphenylacetic acid (L) and the remaining free epoxy groups were reacted away by heating to high temperature as in Example 1. The results of the lower fusing limits determined by measurements of the visco-elastic properties, and working ranges, of the toner powders are given in the following table.

| Toner Powder | Phenol | Tg Reaction Product (°C.) | Tg Mixture (°C.) | Lower Fusing Limit (°C.) | Working Range Width (°C.) |
|---|---|---|---|---|---|
| 8a | E | 49 | 51.5 | 84 | 18.5 |
| 8b | F | 37 | 43 | 76.5 | 18.5 |
| 8c | G | 35.5 | 42.5 | 74.4 | 19.5 |
| 8d | H | 49.5 | 48 | 84.5 | 16 |
| 8e | I | 41 | 44.5 | 78.5 | 18 |
| 8f | J | 46 | 50.5 | 86 | 19 |
| 8g | K | 44.5 | 49 | 87.5 | 19 |
| 8h | L | 31 | 42 | 87 | 22 |

Example 9

Toner powders were prepared in accordance with Example 2 with a thermoplastic resin containing 60% by weight of the reaction product of Epikote 828 (Shell) and p-phenylphenol and 40% by weight of polyester resin based on polyoxyethylene(2)-2,2-bis(4-hydroxyphenyl)propane and a 30:70 mixture of adipic acid and terephthalic acid, using polyester resins with an MFI (melt flow index) of 1.1 and 2.1 g/min respectively at 125° C. The resulting toner powders were used in an electrophotographic copying machine as described in Example 2. The various toner powders had an identical lower fusing limit of 85° C. For comparison, two toner powders were prepared in accordance with Example 2 based on a polyester resin based on maleic acid anhydride and polyoxypropylene(2)-2,2-bis(4-hydroxyphenyl)-propane with MFI's of 0.9 and 1.9 g/min respectively at 105° C. A difference of 7°–8° C. in the lower fusing limit was found between these toner powders.

Example 10

A toner powder was prepared by meltblending 91% by weight of thermoplastic resin, containing 40% by weight of the reaction product of Epikote 828 (Shell) and p-phenylphenol from Example 1 and 60% by weight of the polyester resin of Example 2, 6% by weight of Printex 35 (Degussa) and 3% by weight of Bontron N-04 nigrosine dye (Orient Chemical, Japan).

The resulting mixture was processed in known manner by cooling and subsequent grinding and screening to give a toner powder having particles between 6 and 16 μm. The particles were subsequently mixed thoroughly with 0.25% by weight of hydrophobic silica (Aerosil R972, Degussa) 1 part of this toner powder was then added to 30 parts of ferrite carrier particles (magnetite, particle size 75–120 μm from Höganäs, Sweden). The carrier particles were coated with 0.25% of a polyvinylidene fluoride resin, in a manner well known in the art.

The mixture of toner particles and carrier particles was then used in a standard electrographic device wherein the toner particles were triboelectrically charged. The charge present on the toner particles was 18 μC/g. Even after prolonged use of the carrier particles the triboelectric charge remained essentially constant. After 20,000 imaging cycles a charge of 16 μC/g was found on the toner particles.

Example 11 (Comparative)

A mixture composed of toner particles and carrier particles was prepared according to Example 10 using as a thermoplastic resin the polyester resin of Example 5. After triboelectric charging the charge present on the toner particles was 18 μC/g. After 20,000 imaging cycles the charge on the toner was 10 μC/g.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A toner powder for the development of latent electrostatic or magnetic images, said toner powder comprising a polyester resin composition of an etherified diphenol and a dicarboxylic acid, and a reaction product of an epoxy resin and a phenol compound wherein said polyester resin has a number-averaged molecular weight of at least 2500, said epoxy resin has a number-averaged molecular weight of less than 1200 and epoxy groups of said epoxy resin are in least 60% blocked by a monofunctional phenol compound.

2. A toner powder according to claim 1, wherein said epoxy groups of said epoxy resin are at least 80% blocked by said phenol compound.

3. A toner powder according to claims 1 or 2, wherein said reaction product of epoxy resin comprises mainly a diglycidyl ether of 2,2-bis(4-hydroxyphenyl)-propane and a monofunctional phenol compound.

4. A toner powder according to claim 3, wherein a ratio of said polyester resin:epoxy resin reaction product is between 80:20 and 20:80.

5. A toner powder according to claim 4, wherein said polyester resin epoxy resin reaction product ratio is between 60:40 and 30:70.

6. A toner powder according to claim 3, wherein the reaction product of said epoxy resin and said phenol compound has a glass-transition temperature above 35° C.

7. A toner powder according to claim 6, wherein the reaction product of said epoxy resin and said phenol compound has a glass-transition temperature above 45° C.

8. A toner powder according to claim 3, wherein said polyester resin comprises a reaction product of one or more alkoxylated bisphenol compounds and one or more aromatic and/or fully saturated dicarboxylic acids or their corresponding esters.

9. A toner powder according to claim 8, wherein said polyester resin comprises a reaction product of polyoxyethylene(2) -2,2-bis(4-hydroxyphenyl)propane and a dicarboxylic acid selected from at least one member of the group consisting of phthalic acid, terephthalic acid, isophthalic acid and their corresponding esters.

10. A toner powder according to claim 8, wherein said polyester resin is mainly a reaction product of polyoxyethylene(2)-2,2-bis(4-hydroxyphenyl)propane and a dicarboxylic acid selected from at least one member of the group consisting of phthalic acid, terephthalic acid, isophthalic acid and their corresponding esters and adipic acid.

11. A toner powder according to claim 8, wherein a ratio of said polyester resin:epoxy resin reaction product is between 80:20 and 20:80.

12. A toner powder according to claim 11, wherein said polyester resin:epoxy resin reaction product ratio is between 60:40 and 30:70.

* * * * *